US005725284A

United States Patent [19]

Boyer

[11] Patent Number: 5,725,284

[45] Date of Patent: Mar. 10, 1998

[54] WHEEL FOR IN-LINE SKATES

[75] Inventor: Geoffrey Boyer, Pointe-Claire, Canada

[73] Assignee: Glenn Boyer Technologies Inc., Montreal, Canada

[21] Appl. No.: 564,602

[22] Filed: Nov. 29, 1995

Related U.S. Application Data

[63] Continuation-in-part of Ser. No. 349,932, Dec. 6, 1994, abandoned.

[30] Foreign Application Priority Data

Nov. 29, 1994 [CA] Canada ..... 2,136,907

[51] Int. Cl.[6] ..... B60B 5/02

[52] U.S. Cl. ..... 301/5.3; 301/64.7

[58] Field of Search ..... 301/5.3, 5.7, 64.7; 280/11.22, 11.23

[56] References Cited

U.S. PATENT DOCUMENTS

| | | | |
|---|---|---|---|
| 285,836 | 10/1883 | Otis . | |
| 2,878,071 | 3/1959 | Fowlkes . | |
| 4,472,340 | 9/1984 | Borden et al. . | |
| 4,855,096 | 8/1989 | Panaroni . | |
| 5,129,709 | 7/1992 | Klamer . | |
| 5,310,250 | 5/1994 | Gonsior . | |
| 5,320,418 | 6/1994 | Chen . | |
| 5,351,974 | 10/1994 | Cech . | |
| 5,362,075 | 11/1994 | Szendel . | |
| 5,401,037 | 3/1995 | O'Donnell et al. . | |
| 5,503,466 | 4/1996 | Lew | 301/5.3 |
| 5,560,685 | 10/1996 | De Bortoli | 301/5.3 |
| 5,567,019 | 10/1996 | Raza et al. | 301/5.3 |
| 5,573,309 | 11/1996 | Bekessy | 301/5.3 |

FOREIGN PATENT DOCUMENTS

| | | |
|---|---|---|
| 1036857 | 9/1953 | France . |
| 628872 | 4/1936 | Germany . |
| 92823 | 9/1992 | Italy . |
| 92824 | 9/1992 | Italy . |

*Primary Examiner*—Russell D. Stormer
*Attorney, Agent, or Firm*—Notaro & Michalos PC

[57] ABSTRACT

There is disclosed an improved skate wheel for an in-line skate comprising a hub for rotation about an axis and a plurality of layers of material disposed concentrically about the hub, each of the layers consisting of a material having a predetermined durometric hardness, the outermost of the layers including an outer surface adapted for a rolling motion of the wheel over a surface.

23 Claims, 12 Drawing Sheets

WHEEL FOR IN-LINE SKATES

This application is a continuation-in-part of U.S. patent application Ser. No. 08/349,932 filed Dec. 6, 1994 now abondoned.

FIELD OF THE INVENTION

The present invention relates to in-line skate wheels. More specifically, the invention relates to the shape and construction of in-line skate wheels.

BACKGROUND OF THE INVENTION

Since its inception in 1980 , in-line skating has rapidly gained acceptance and popularity to become one of the fastest growing sports in North America and elsewhere. Each year, thousands of new in-line skaters take to this new activity as a form of fitness or recreation. Organized events such as racing, roller hockey, recreational skating and artistic skating are increasingly being staged in many neighbourhood communities.

Modelled after ice skating, in-line skating incorporates many of the traditional techniques practised in its sister sport. Ice manoeuvres such as the basic 45° sideways push out, sculling, and crossover turning are all similarly performed on wheels.

To enhance the safe performance of these manoeuvres on the road, today's in-line skates are equipped with polyurethane wheels capable of maintaining good traction against the ground when the skate is in motion. In addition, these relatively soft wheels (approximately 78A durometer (hardness)) also assist in propelling the skater by generating a spring effect as the skater pushes off the skate during his/her forward stride and cushion the feel of the road.

Associated with these soft wheels however is an increase in the amount of rolling resistance. Greater effort must be expended by the skater to overcome the increased friction which causes a loss of performance particularly on straightaways. Another disadvantage inherent to the use of softer wheels is their tendency to wear out quickly. Harder wheels are therefore preferred because they reduce rolling resistance and it seems that users will sacrifice a bit of comfort for improved performance.

A compromise has been proposed by Klamer in U.S. Pat. No. 5,129,709 who discloses an in-line skate wheel having a relatively hard central core body flanked symmetrically by a pair of side wall bodies made of a softer material. Thus, when the skater is moving straight ahead purportedly substantially only the relatively hard radially outer surface of the central core will be in contact with the ground to minimize rolling resistance and increase speed. On curves however, the softer side wall bodies will contact the ground to increase traction for better grip and handling. This configuration however funnels large amounts of shock and vibration to the wheel's hub and then to the skater.

Moreover, despite such improvements to in-line skate wheels, there is still a considerable performance gap between in-line and ice skates, particularly in the areas of tight turns, T-stops and the ability to control or shed speed by snow plowing particularly for novices and children when rolling downhill or when approaching an opponent's goal prior to shooting.

Existing brakes for in-line skates comprise a piece of hard rubber or polyurethane affixed to the underside of the heel portion of the skate(s). To actuate this braking mechanism, a skater usually scissors the braking leg forward to transfer most of his/her weight on the braking leg. The scissored leg is then used to depress the brake heel along the ground in the direction of travel. Braking in this manner is unnatural, ineffective, and quite often unsafe. A more natural positioning and efficient stop can be attained either by snow plowing or by turning sideways to the direction of travel and sliding to a stop as if on ice skates. This technique is known as power sliding or power stopping and requires a highly skilled in-line skater for its successful performance. Attempting this manoeuvre with existing technology will send the average skater head over heels.

SUMMARY OF THE INVENTION

It is therefore an object of the present invention to provide an improved wheel for use on in-line skates that minimizes rolling resistance and decreases the effort the skater must expend.

It is another object of the invention to provide an improved wheel for use on in-line skates having the beneficial shock absorption characteristics and spring effect provided by currently available "soft" wheels while also providing the performance advantages offered by harder wheels.

It is still another object in a preferred embodiment of the invention to provide an improved wheel for use on in-line skates capable of lateral or sliding stop movements.

It is still a further object of the preferred embodiments of the present invention to provide an improved wheel for use on in-line skates incorporating some or all of the foregoing advantages for specific uses including racing, outdoor everyday skating over uneven, non-homogenous surfaces, high performance play on smooth, homogeneous sport surfaces and stunt skating.

According to the present invention then, there is provided a wheel for an in-line skate, comprising hub means for rotation about an axis, circular ring means disposed concentrically about said hub means, said ring means having an outer ground engaging peripheral surface, and core means disposed concentrically about said hub means for at least partially supporting said ring means in a ground engaging position thereof, said core means having an outer ground engaging peripheral surface and being made of a material having a higher coefficient of friction compared to said ring means, wherein the diameter of said ring means exceeds the diameter of said core means to provide a discrete radial transition from said ground engaging surface of said core means to said ground engaging surface of said ring means.

According to a further aspect of the present invention then, there is provided a skate wheel for an in-line skate comprising hub means for rotation about an axis, a plurality of layers of material disposed concentrically about said hub, each of said plurality of layers consisting of a material having a predetermined durometric hardness, the outermost of said layers including an outer surface adapted for a rolling motion of said wheel over a surface.

BRIEF DESCRIPTION OF THE DRAWINGS

Preferred embodiments of the present invention will now be described in greater detail and will be better understood when read in conjunction with the following drawings, in which.

DETAILED DESCRIPTION

Figure 1:
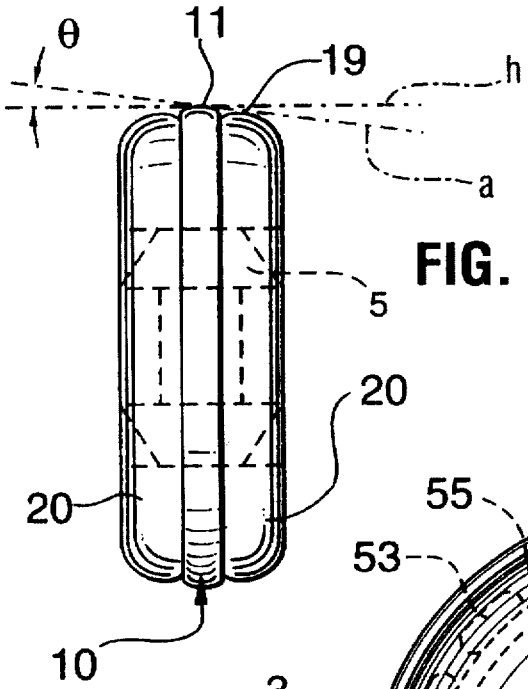
FIG. 1 is a front elevational, partially sectional view of the present wheel.

With reference to FIG. 1, the present wheel in its basic form comprises a hub 5, and a pair of outer sidewalls 20 of polyurethane sandwiching a central disk or slip ring 10 of relatively hard material, the outer ground engaging annular surface 11 of ring 10 being raised to radially protrude from the adjacent ground engaging surfaces 19 of sidewalls 20. Advantageously, a line "a" drawn tangentially to both surfaces 11 and 19 defines an angle θ ideally but not necessarily of 22° or in the range of 15° to 35° measured from normally horizontal axis h. Accordingly, the raised or stepped profile of surface 11 relative to surrounding surfaces 19 provides for a controllable transition from the relatively hard material of slip ring 10 to the softer material of sidewalls 20 as the wheels move from a relatively upright position to a more tilted attitude for snow plowing and lateral stops. This allows the skater to more easily take advantage of the different properties and characteristics offered by the inner and outer layers and to gradually and controllably bring the softer resin of the sidewalls into frictional contact with the ground. This avoids sending the skater headlong during such manoeuvres. With use, slip ring 10 will of course wear down from its original diameter but so too will sidewalls 20 so that there will remain a stepped transition between the two for the useful life of the wheel.

Slip ring 10 is advantageously manufactured from a relatively hard material (Shore D85) having a low coefficient of friction permitting slip when performing lateral stops or snow plowing, but which is also possessed of a high degree of impact/abrasion resistance. Suitable materials include UHMWPE or, more preferably, a petrowax-filled nylon %, a molybdenum disulfide ($MoS_2$) filled nylon %, a modified filled polyethylene or thermoplastic polyurethane (TPU). The somewhat "grippier" TPU may be preferred if the wheels are to be used on homogeneous polypropylene playing surfaces as will be described below. These latter materials can be manufactured using injection molding techniques having a lower cost/part life ratio compared to compression molding techniques required for UHMWPE. If UHMWPE is used, it has been found that improved results are obtained by adding 30% by volume glass fiber or beads for greater compressive strength and product integrity. Silicon oil may also be added for a hydroplaning medium in order to improve slip.

Most wheels sold in the market today have a nylon hub adjoining a uniform durometer polyurethane outer body. Conventionally, skaters like softer wheels because they provide a comfortable ride and act like springs which, when released by the push of the leg, rebound to convert energy back into some forward motion. Because the wheels are always on an angle of attack normal to the annular axis of the wheel to the ground to propel a skater, a spring effect is very useful. However, as aforesaid, softer wheels offer a higher rolling resistance and suffer higher abrasion as the price of comfort. The wheels simply wear much faster because of the softer durometer material used in their manufacture. As will now be described in greater detail, Applicant's wheel improves energy conversion in two (or more) part wheels and reduces wear due to abrasion without sacrificing speed and comfort in a wheel that more closely mimics the lateral performance characteristics of an ice skate in terms of permitting ice hockey stops and snow plowing.

As will be appreciated, slip ring 10 as shown in FIG. 1 provides little or no rebound or spring effect nor shock absorption or reduction of road vibration on its own due to the hardness (Shore D85) of the material from which it is made. Rebound is poor as well because the thickness of the ring is the only area transmitting the load back to the hub. These disadvantages are also suffered by Klamer's wheel.

Figure 2:
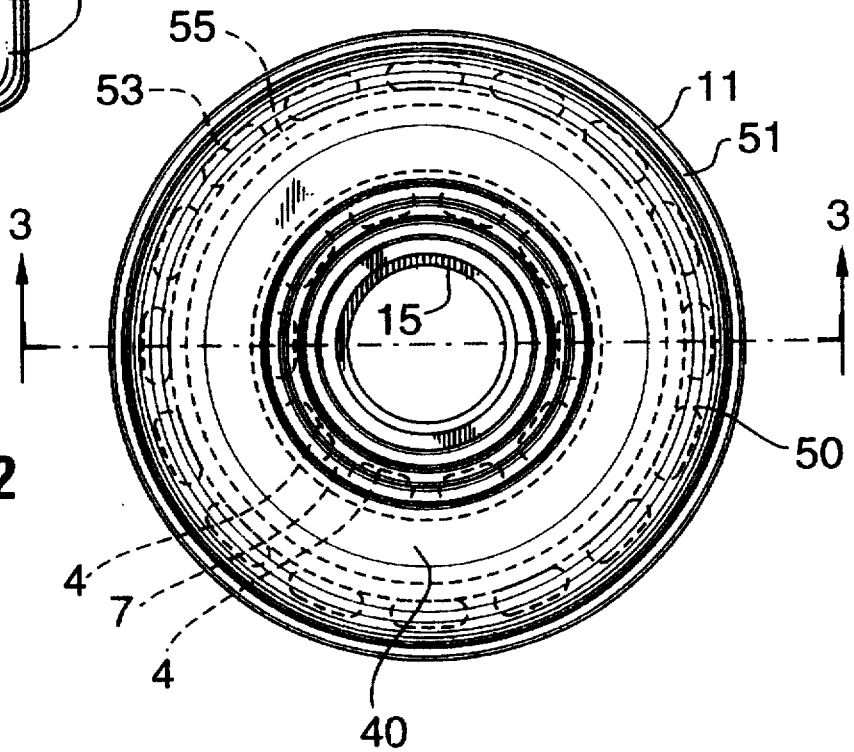
FIG. 2 is a side elevational view of the present wheel adapted for all-terrain use.
Figure 3:
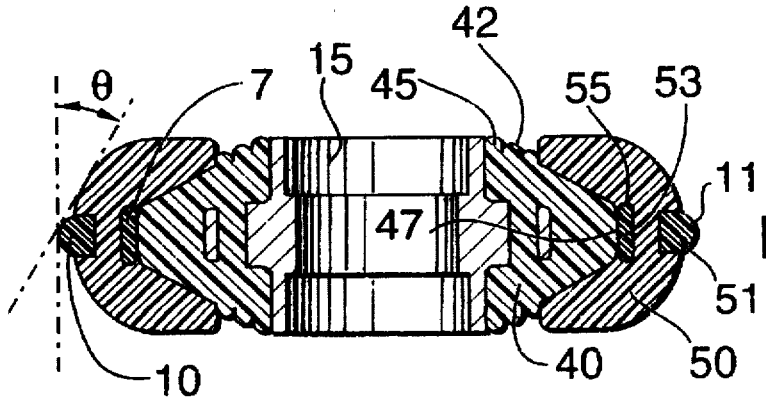
FIG. 3 is a cross-sectional view of the wheel of FIG. 2 along the line A—A.

With reference to FIGS. 2 and 3 wherein like numerals are used to denote like elements, these problems are overcome by means of a modified multi-durometer multiple layered wheel including a nylon hub 15 adjoined to a softer durometer (40A–80A) middle or inner core 40 which in turn is concentrically adjoined to an outer harder durometer body 50. This minimizes both abrasion and rolling resistance by using a harder outer body (for example, 72A–96A) while absorbing shock to the foot and giving maximum rebound with every push of the leg due to the relative softness of inner core 40. In this context, rebound is considered the height a wheel recovers from an initial drop height when dropped on a skating surface. The higher the recovery height the better the rebound.

Figure 4:
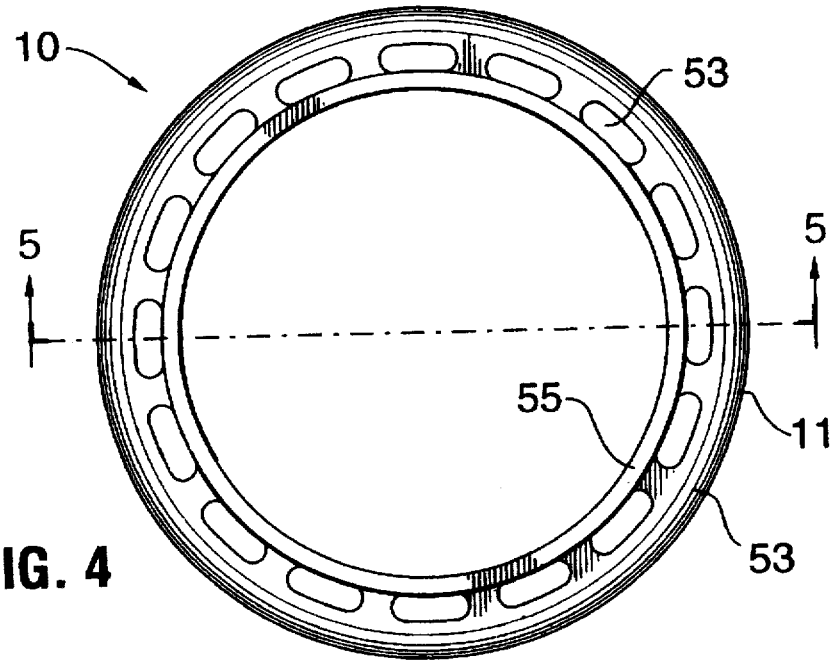
FIG. 4 is a side elevational view of a slip ring forming part of the wheel of FIG. 3.
Figure 5:
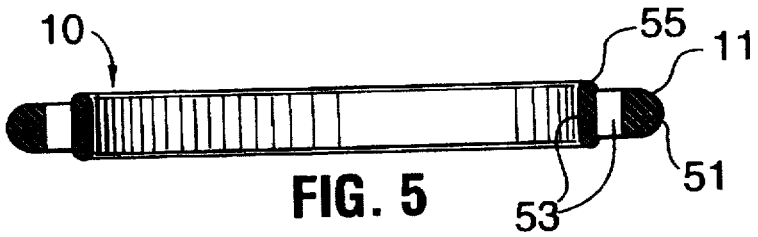
FIG. 5 is a cross-sectional view of the slip ring of FIG. 4 along the line A—A.
Figure 6:
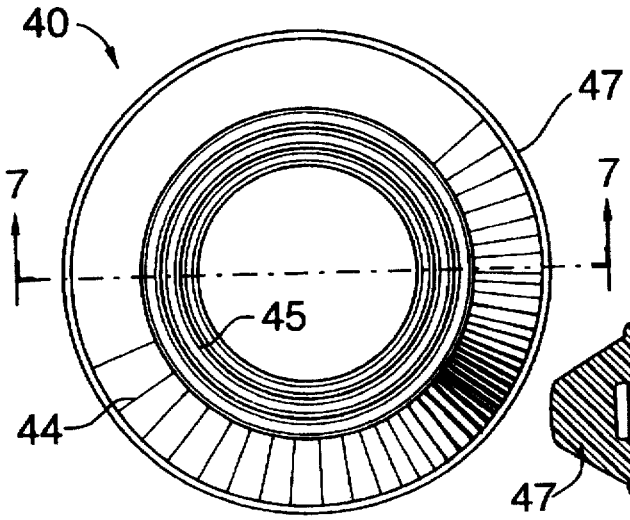
FIG. 6 is a side elevational view of an inner core forming part of the wheel of FIG. 3.
Figure 7:
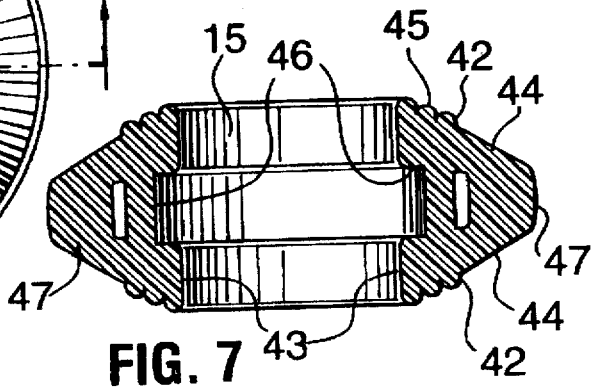
FIG. 7 is a cross-sectional view of the inner core of FIG. 6 along the line B—B.
Figure 9:
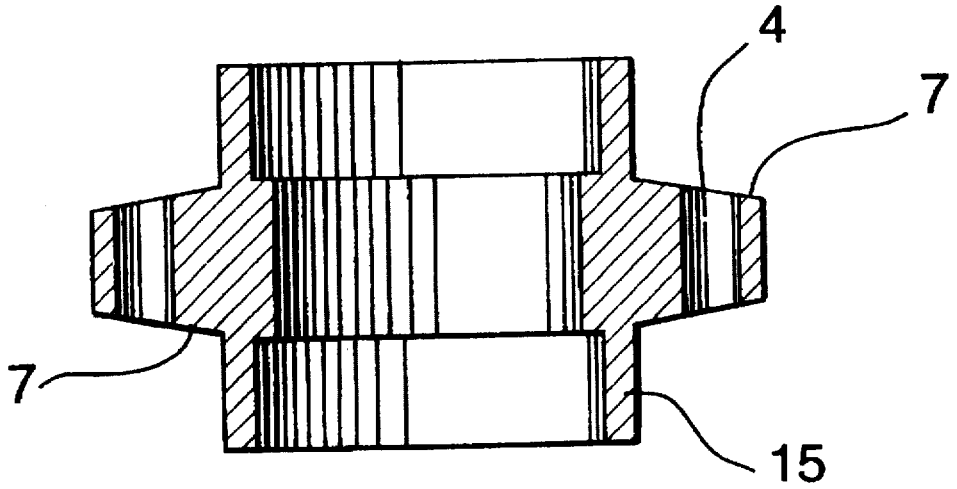
FIG. 9 is a cross-sectional view of the hub of FIG. 8 along the line C—C.
Figure 10:
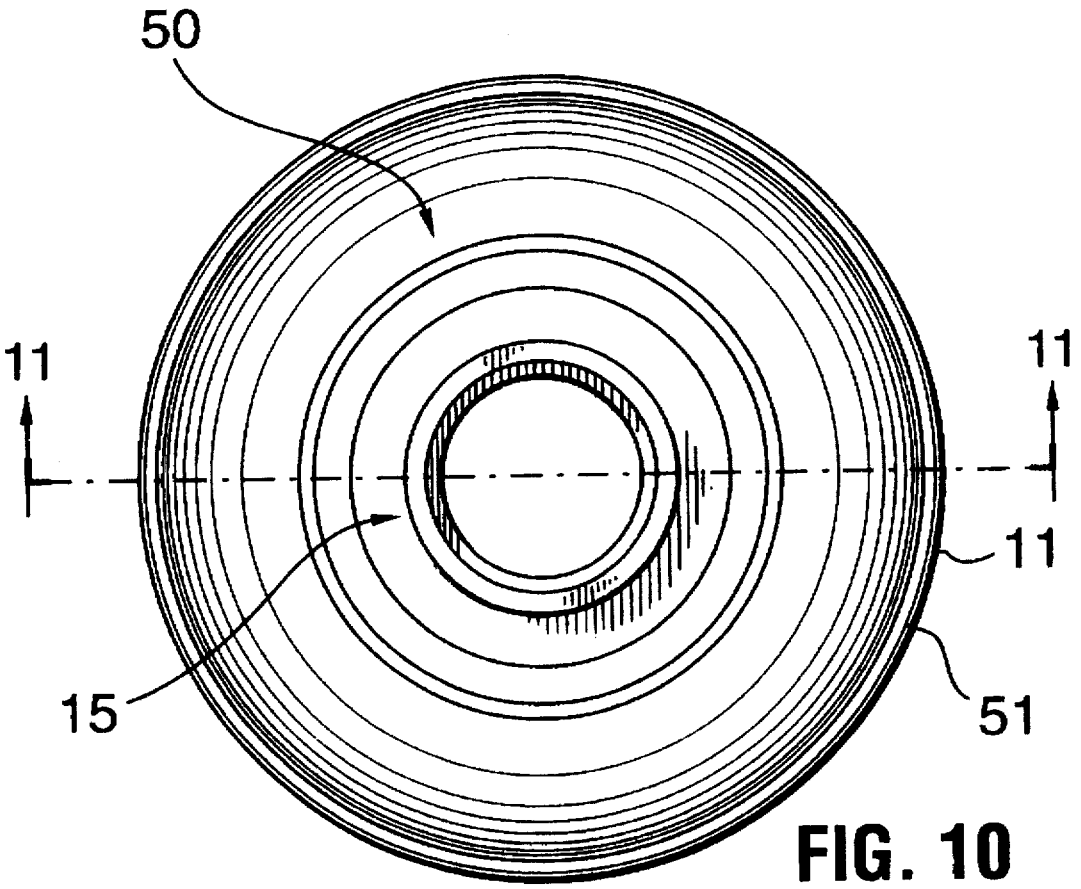
FIG. 10 is a side elevational view of a further modified wheel.
Figure 11:
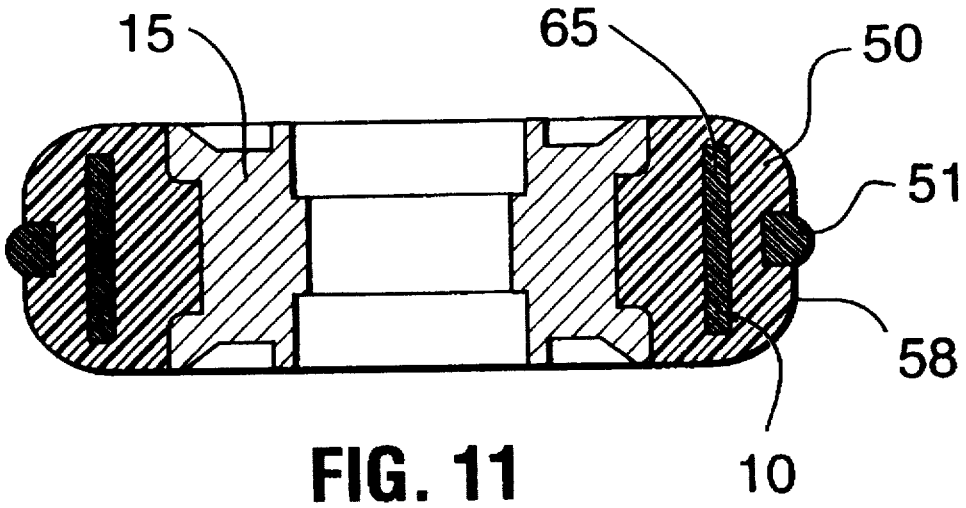
FIG. 11 is a cross-sectional view of the wheel of FIG. 10 along the line A—A.
Figure 12:
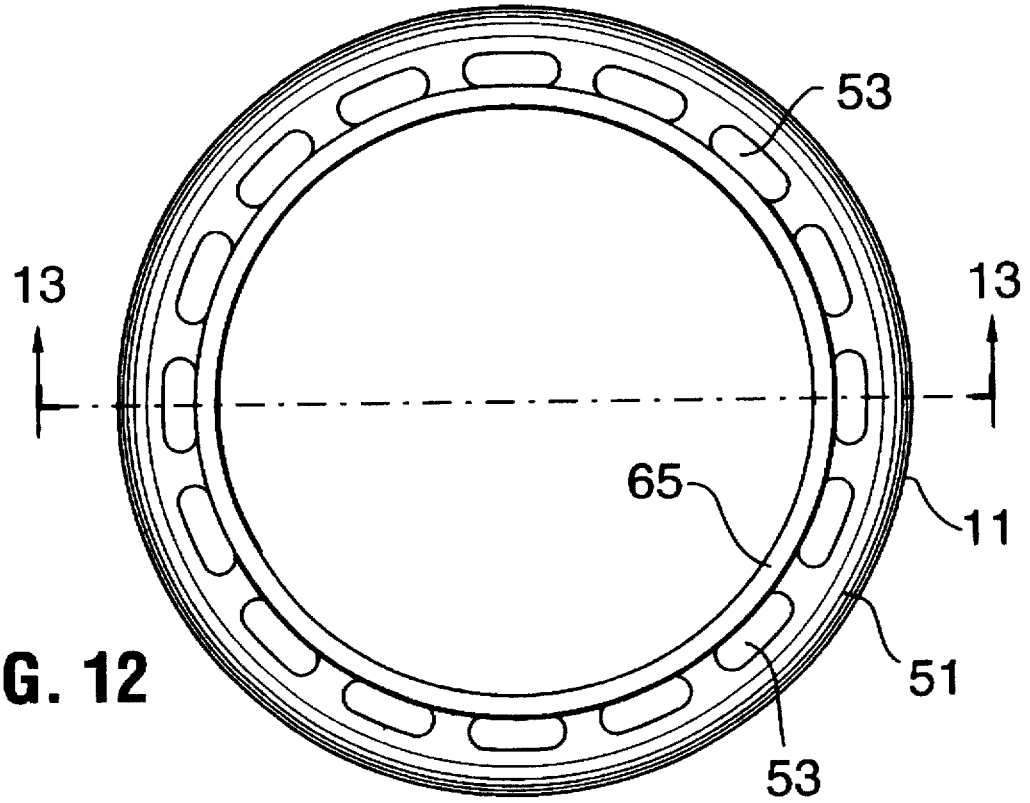
FIG. 12 is a side elevational view of the slip ring of the wheel of FIG. 10.
Figure 13:
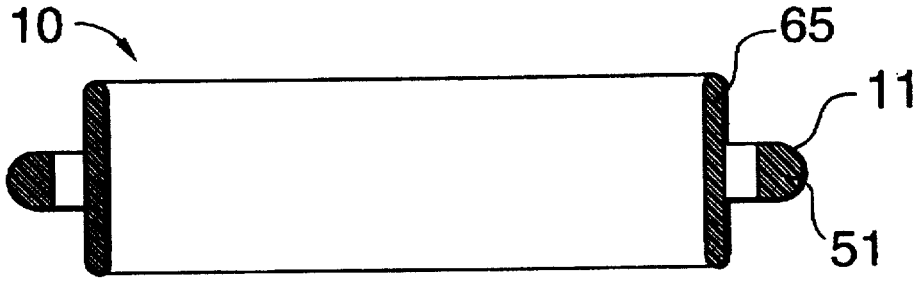
FIG. 13 is a cross-sectional view of the slip ring of FIG. 12 along the line A—A.

In the embodiment of FIG. 2 and with particular reference to FIGS. 3 to 5, it will be seen that a slip ring 10 is additionally included and is supported within outer body 50. Each slip ring includes an outer ground-engaging portion 51, a plurality of apertures 53 formed therethrough for mechanical adhesion to the polyurethane outer body 50, and an inner T-ring 55 that distributes the load on the slip ring to the softer inner body. Inner body 40 may include bellows 45 formed on opposite outer sidewalls 42 thereof for aesthetics and which might also (perhaps) improve shock absorption and resiliency. With reference to FIG. 7, each side of inner body 40, when seen in cross-section, is roughly frusto-conical in shape including a basal surface 43 that adjoins hub 15, tapered flanks 44 and contiguous shoulders 42, and a crown 47 that abuts inner opposed surface 53 of T-ring 55. Crown 47 may be formed with a slight outwardly convex curvature as seen best from FIG. 7 and also is advantageously slightly wider than abutting surface 53 of the T-ring for maximum load transference from the T-ring to soft core 40. A circumferentially extending groove 46 in basal surface 43 is shaped to conformably receive annular hub insert or nib 7 (FIG. 9) thereinto to position and centre body 40 relative to the hub. Hub 15 and body 40 may be bonded together and additional mechanical adhesion is provided by the string of apertures 4 formed through nib 7 along its length. As will be appreciated, the material comprising body 40 flows through and solidifies into and about these apertures to form a strong and permanent connection with the hub. In other respects, hub 15 is conventional in size and shape and need not be described further herein.

It will be seen that in the embodiment of FIGS. 10 to 13, soft core 40 is omitted but a wider T-ring 65 is used. This model as shown includes a more squared outer ground engaging surface 58 on outer body 50 for use on polypropylene surfaces commonly called SPORT COURT[1] and similar materials for roller hockey games. The slip ring is quite slippery and the flatter wheel bottom provided by the squared profile has been found to provide for a greater push and stop effect without excessive slipping. Because SPORT COURT and similar surfaces are smooth and regular in nature, the shock absorbing and flexing characteristics of soft core 40 desirable in the all-terrain wheel of FIG. 2 may not be as needed but this of course will be subject to the preferences of the user, as will the cross-sectional shape of ground engaging surface 58. The all-terrain shape of FIG. 3 as well as the profile of FIG. 15 can also be used with good results on playing surfaces and could well be preferred by some users. Hub 15 is another conventional configuration and will not therefore be described in greater detail. This style of hub obviously lacks annular nib 7. Bonding between hub 15 and outer body 50 (or core 40 if present) may be conventional chemical or covalent adhesion.

[1] Trade-mark

In the all-terrain wheel exemplified by the embodiment of FIGS. 2 and 3, the wheel's outer profile is somewhat more rounded because more traction is inherently available from cement, asphalt and other irregular surfaces typically found outdoors. This wheel provides for great manoeuvrability in view of its combination of profile and dual durometer construction. This permits the marketing of wheels having only a single outer diameter. It's typical to use, for example, a 72 mm wheel for more manoeuvrability, but at the cost of speed. For more speed, a wheel having a larger outer diameter (e.g. 78 mm) would be purchased. The present wheel, with or without the slip ring, can be manufactured, if desired, in a single size of, for example, 76.5 mm to provide both speed, manoeuvrability and enhanced braking capabilities.

Figure 14:
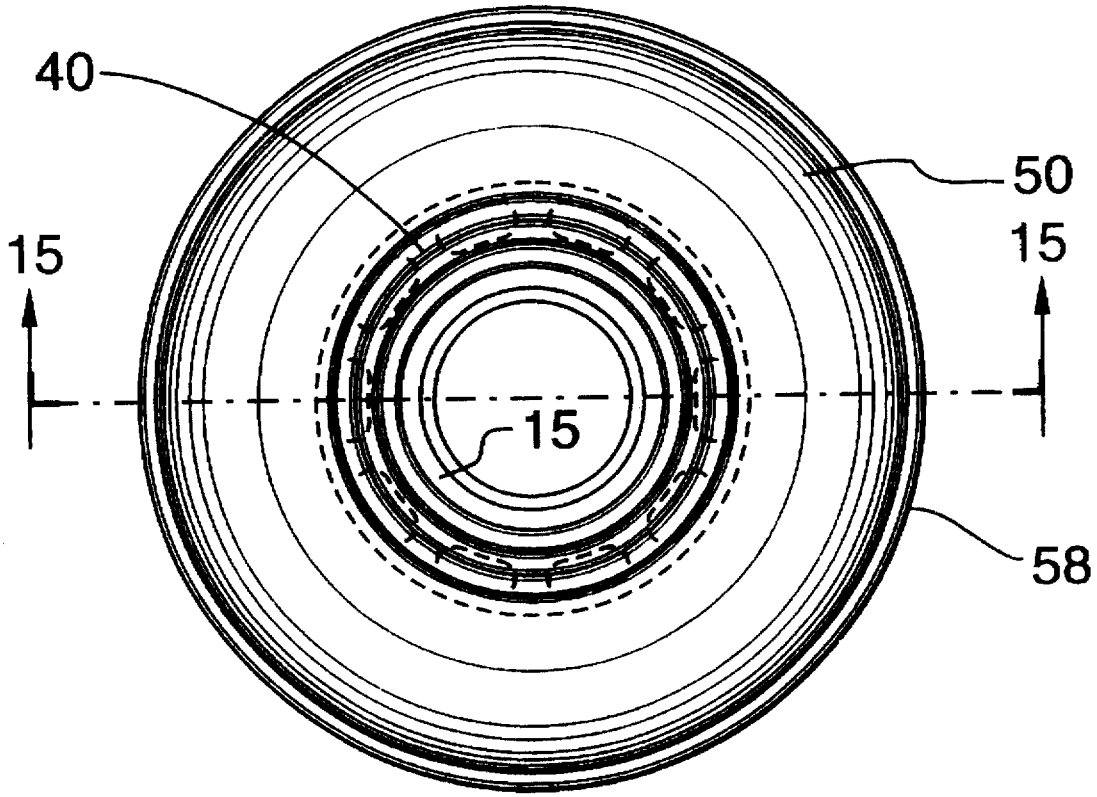
FIG. 14 is a side elevational view of a further modified wheel for racing.
Figure 15:
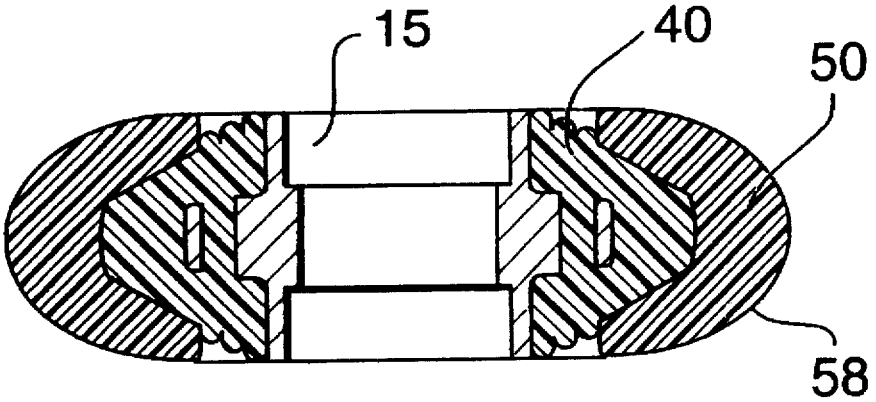
FIG. 15 is a cross-sectional view of the wheel of FIG. 14.

As stopping is not as important a requirement in racing, applicant's dual durometer racing wheel as exemplified by the embodiment of FIGS. 14 and 15 is shown without a slip ring. In other respects, this wheel is similar to applicant's all-terrain wheel shown in FIG. 2 apart from the curvature of outer ground engaging surface 58 of outer body 50. For racing, the cross-sectional profile of surface 58 is advantageously more parabolic in shape as best seen from FIG. 15.

Figure 16:
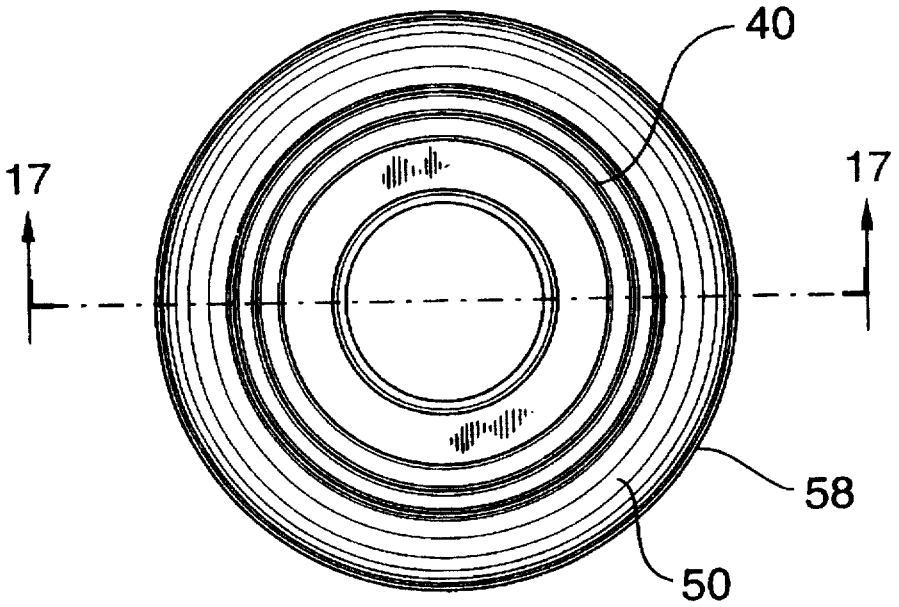
FIG. 16 is a side elevational view of a further modified wheel for stunt skating.
Figure 17:
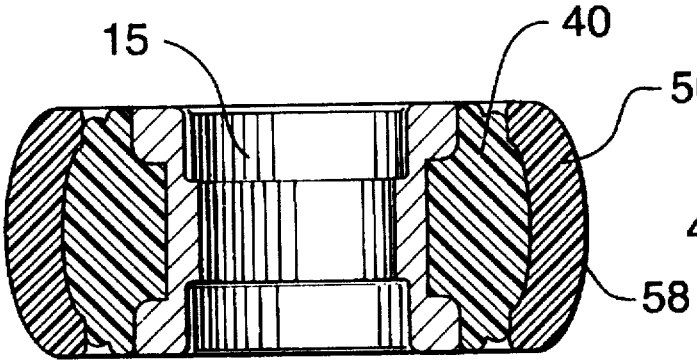
FIG. 17 is a cross-sectional view of the wheel of FIG. 16 along the line A—A.

A similar embodiment with a soft core 40 but without a slip ring which is particularly useful for stunt skating is shown in FIGS. 16 and 17. This wheel is somewhat wider and is also quite squat in shape, with ground engaging surface 58 of outer body 50 having a relatively large radius of curvature for maximum ground contact. The hardness of outer body 50 will advantageously be in the range of 88A to 96A.

Figure 18:
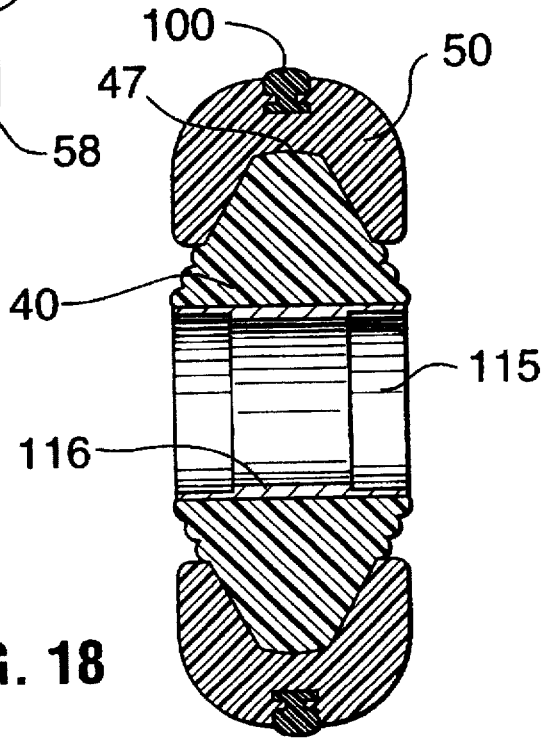
FIG. 18 is a cross-sectional view of a modified dual durometer wheel.
Figure 21:
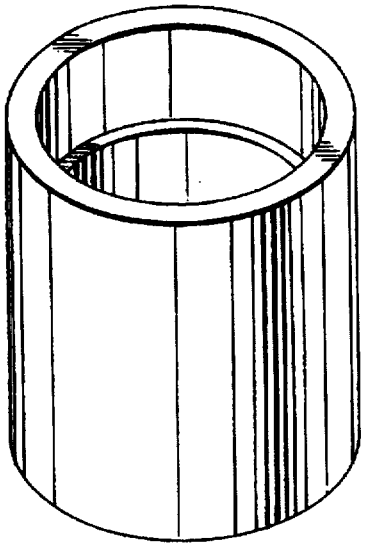
FIG. 21 is a perspective view of a tube-style hub for use in connection with an in-line skate wheel.
Figure 22:
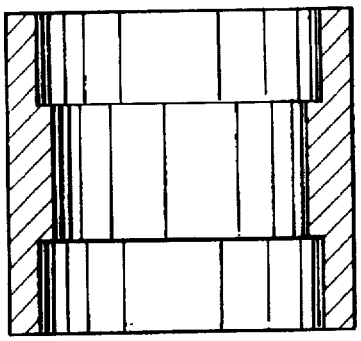
FIG. 22 is a plan view of the hub of FIG. 21.
Figure 23:
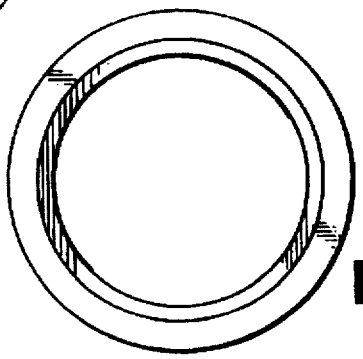
FIG. 23 is a side elevational view of the hub of FIG. 21.

Another wheel construction is shown with reference to FIG. 18 wherein once again like numerals are used to denote like elements. As will be seen, the wheel is of dual durometer construction including a relatively soft inner core 40, a harder polyurethane outer core 50 and a hub 115 which in this instance is a simple tube-type hub which is shown in greater detail in FIGS. 21 to 23 and is commercially available from B. F. Goodrich as the ESTALOC™ 59300. With this sort of hub, the hub's outer peripheral surface 116 is covalently bonded to the polyurethane wheel material to form a permanent connection therebetween.

In this embodiment, it will be seen that slip ring 100 "floats" in outer core 50 and therefore lacks a T-ring 55 that contacts crown 47 of core 40 for load transfer. This permits ring 100 to be more flexible. It has been found that the stiffer the slip ring, the greater the wheel's loss of rebound (bounce), speed, vibration damping and enjoyment of ride. It remains desirable nevertheless that the slip ring present a uniform and non-segmented configuration to the ground. O'Donnell in U.S. Pat. No. 5,401,037 attempts to retain a larger ring while addressing the flexibility problem by using a relatively large disk with segmented, spiralled or wavy sections. O'Donnell purports for example that separated disk sections remain flexible because they are jointed at only one end. The problem with these configurations however is that segments, waves and spirals all present a non-smooth and patterned configuration to the ground that sets up a high frequency vibration as the outer surface of the wheel transitions between relatively hard disk material and relatively soft wheel material between the disk segments as it rolls along. Users of this sort of wheel find the feel unacceptable after as little as five minutes of skating.

Figure 19:
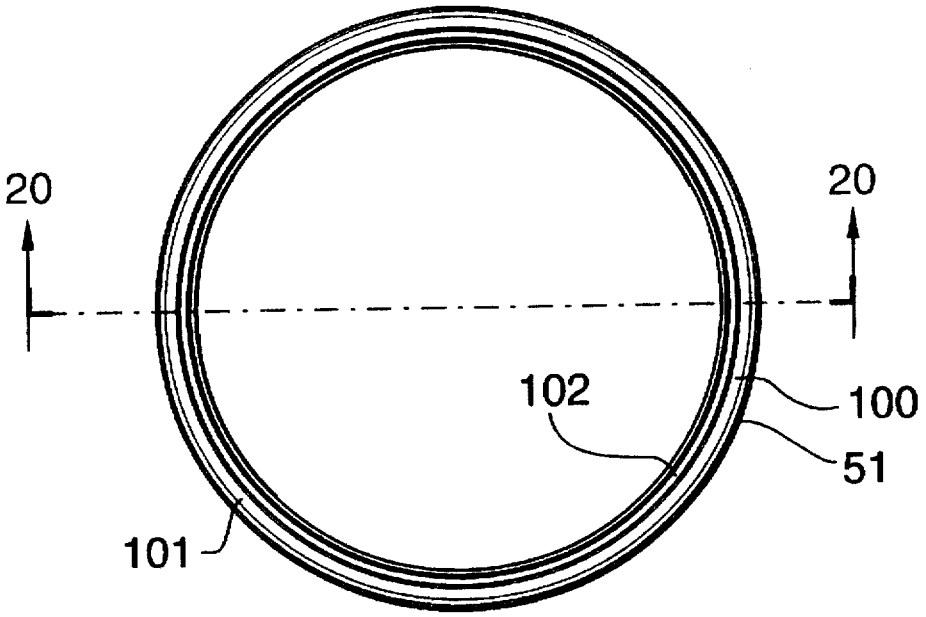
FIG. 19 is a side elevational view of a slip ring forming part of the wheel of FIG. 18.
Figure 20:
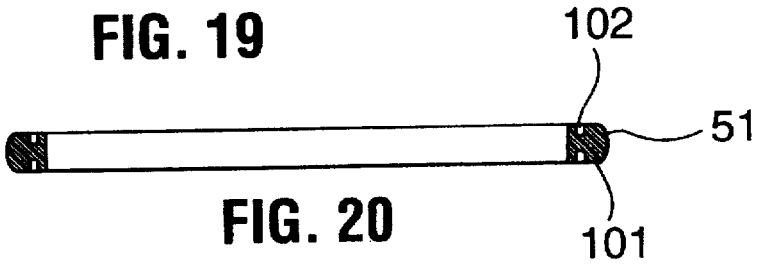
FIG. 20 is a cross-sectional view of the slip ring of FIG. 19 along the line A—A.

With reference to FIGS. 19 and 20, slip ring 100 retains its outer ground engaging portion 51 that is radially raised relative to the surrounding ground engaging surfaces of outer core 50. The radius of curvature of surface 51 may vary considerably but will typically fall in the range of 0.050 to 0.250 inches. Seen best from FIG. 20, the ring's side walls 101 include circumferentially extending preferably continuous grooves 102 to augment chemical and mechanical connection to the surrounding and supporting polyurethane of outer layer 50.

Although slip ring 100 is advantageously as flexible as possible, it should also, in order to provide the advantages of power stopping, etc. have a lower coefficient of friction than that of the material comprising outer core 50. To date, the best known material for the construction of a more flexible ring 100 is polybutylene terephthalate and a soft (amorphous) segment based on long-chain polyether glycol sold commercially by DuPont™ under the trade-mark HYTREL. For outdoor applications, HYTREL 6356 is proposed whereas for indoor applications particularly on uniform and/or homogenous playing surfaces HYTREL 5526 is proposed. HYTREL has a higher coefficient of friction than UHMWPE, TEFLON™ or the other ring materials mentioned above, but is nevertheless "slippery" enough to provide the advantages sought from a slip ring. Moreover, having a higher coefficient of friction than some other materials means a reduction in slip when slip is not wanted. The lateral width of the slip ring will vary for optimal results depending upon the material used. For example, a narrower or thinner slip ring is appropriate when using a relatively "slippery" material. Conversely, a wider ring provides better results when using a less slippery material. Thus, the width of the ring will be chosen depending upon the material used in order to obtain the desired balance between slip and grip. When using HYTREL, a ring width of 0.200" has been found to provide good results but even this may vary depending upon the type or grade of HYTREL being employed.

The raised profile of the slip ring makes it easier for first time users to adapt to the wheels. The wheels will also "break in" to the style and wear pattern of each individual user. For example, the ring will wear to the individual angle of braking for each skater.

It has been found that an additional advantage of applicant's unique dual durometer wheel is its ability to flex sideways under bend-inducing torsional loads. This has been found to contribute to a significant reduction in wear, particularly to outer core 50, and to provide better contact with the ground surface at all times. A conventional wheel, particularly one made of a harder material, tends not to flex under such loads, which therefore transfers the load to a narrower width side wall portion of the wheel which then begins to wear quickly and unevenly. Moreover, at such high angles of attack to the ground with the normal force being vectored at a correspondingly higher angle, instability sets in with the wheel eventually losing grip altogether causing the skater to fall. This is comparable to "losing an edge" on an ice skate.

Figure 24:
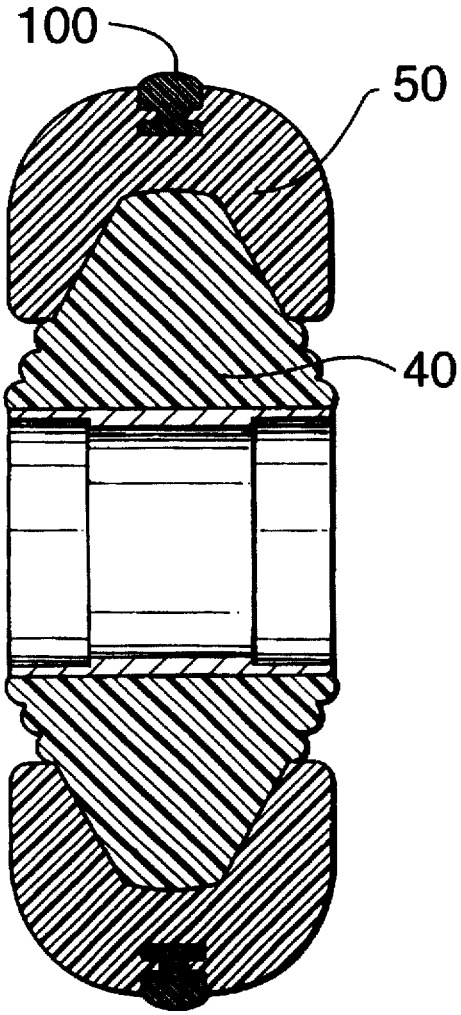
FIG. 24 is a cross-sectional view of the wheel of FIG. 18 in an unflexed condition.
Figure 25:
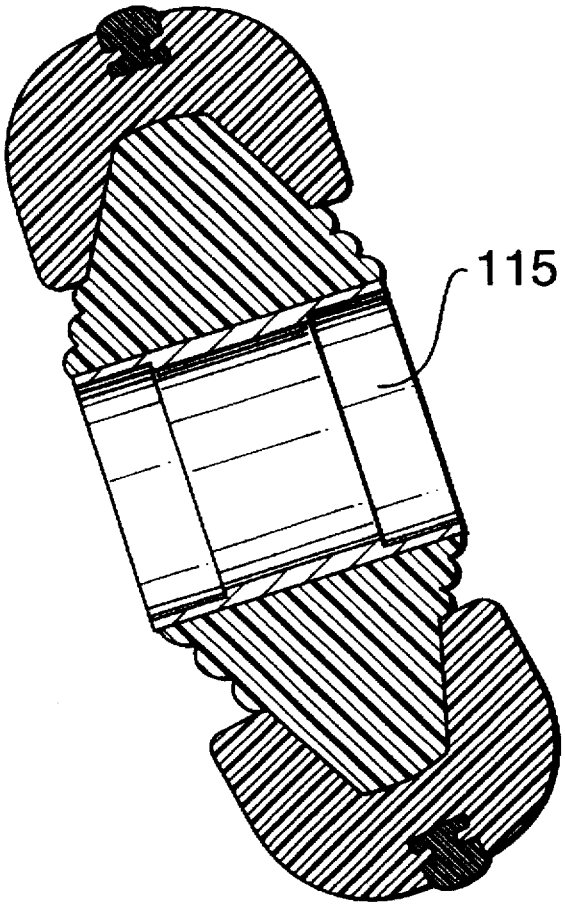
FIG. 25 is a cross-sectional view of the wheel of FIG. 24 in a flexed condition.

The ability of the present wheel to flex is most clearly illustrated in FIGS. 24 and 25. As shown, inner core 40, being of a softer material, can actually flex sideways under torsional loads so that outer layer 50, as seen most clearly in FIG. 25, remains more on the sidewall radii relative to the ground for a more even and secure contact therewith. This advantage flows whether or not slip ring 100 is present in the wheel.

Figure 8:
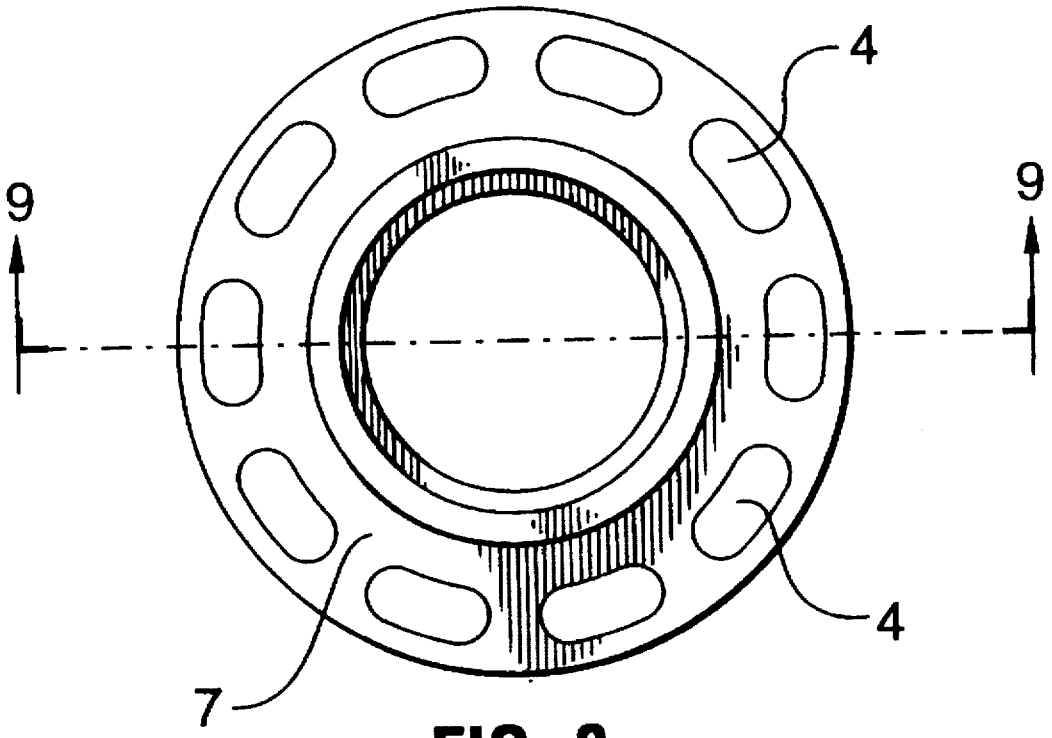
FIG. 8 is a side elevational view of the hub of the wheel of FIG. 3.
Figure 27:
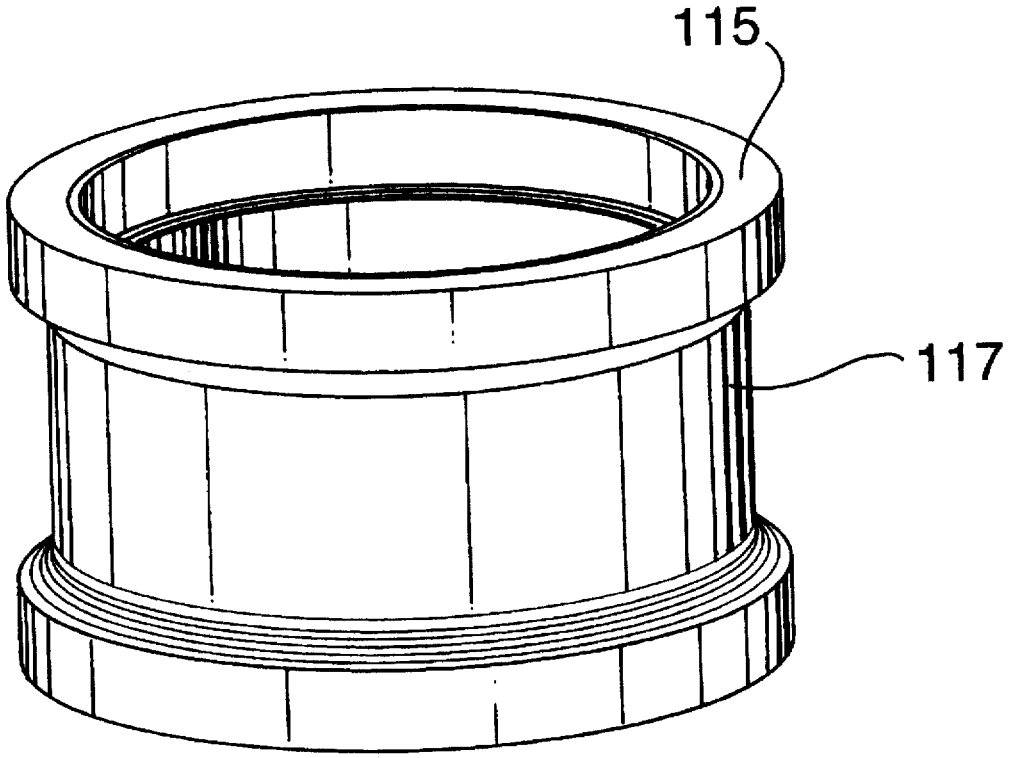
FIG. 27 is a perspective wheel of another tubestyle hub for an in-line skate wheel.

Actually, it has been found that if the inner core flexes too much, the wheels may no longer track straight. Such over-flexing is usually avoided when using the sort of hub 15 illustrated in FIGS. 8 and 9 which includes nib 7. The nib acts as a stiffening spine to prevent or at least minimize over-flexion of core 40. However, not all wheel manufacturers use this sort of hub and the presence of nib 7 itself reduces the amount of relatively soft urethane in inner core 40 disposed between the outer ground engaging surfaces of core 50 and hub 15. Some manufacturers prefer simple tube type hubs 115 such as those shown in FIGS. 21 to 23 and in FIG. 27. Hub 115 in FIG. 27 in particular includes a circumferentially extending middle recess 117. Although the urethane and the hub are normally bonded together covalently, the recess provides additional semi-mechanical undercut so that the urethane also mechanically adheres to the hub for an added margin of safety to the connection.

To avoid over-torsioning in a wheel using a simple tube hub, one approach is to increase the hardness of the inner core's polyurethane (or other material) from, for example, Shore 72A to Shore 76A. The use of the harder material in the inner core is at least partially offset in terms of the loss of damping by the added thickness of the core due to the elimination of nib 7. Thus, good results have been obtained in a wheel with an inner core having a hardness of Shore 76A, and an outer core having a hardness of Shore 86A or 87A.

Figure 26:
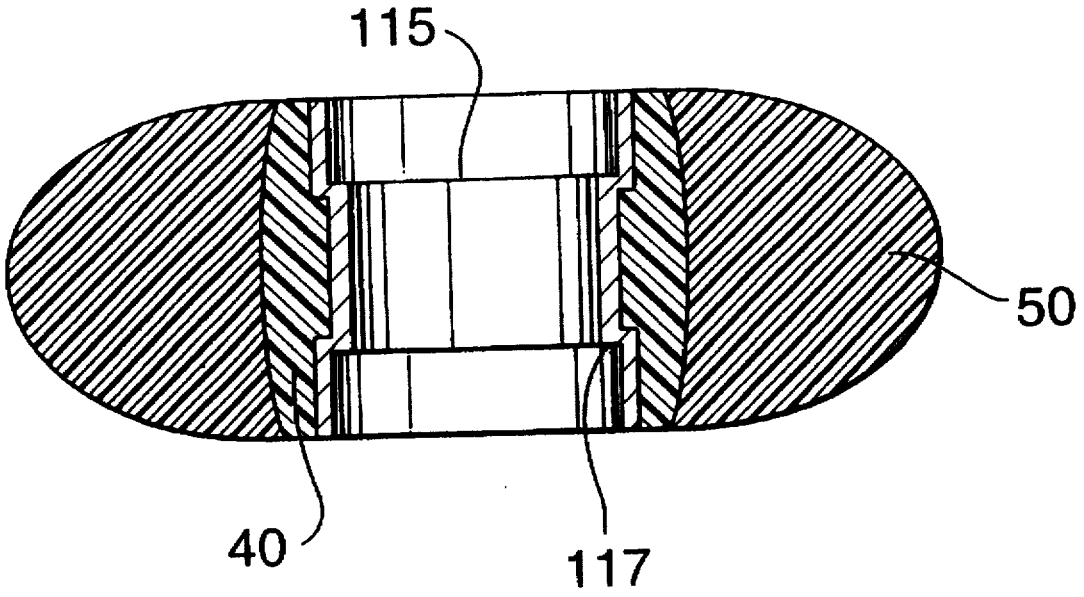
FIG. 26 is a cross-sectional view of a further modified dual durometer in-line skate wheel.

Another approach is to change the cross-sectional shape of inner core 40 as Shown in FIG. 26. As will be seen, in this embodiment, inner core 40 presents a flatter and shallower profile. This profile reduces unwanted torsion under bending loads, and, if desired, the reduction in its thickness can, for damping purposes, be offset in whole or in part by using a softer material, e.g., shore 72A or perhaps lower.

Figure 28:
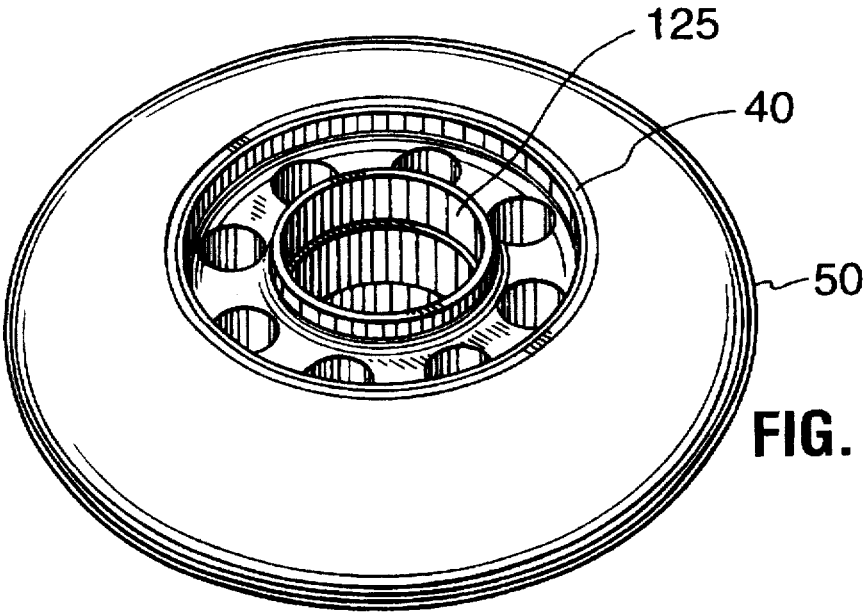
FIG. 28 is a perspective view of a dual durometer wheel on a spoked in-line skate wheel hub.
Figure 29:
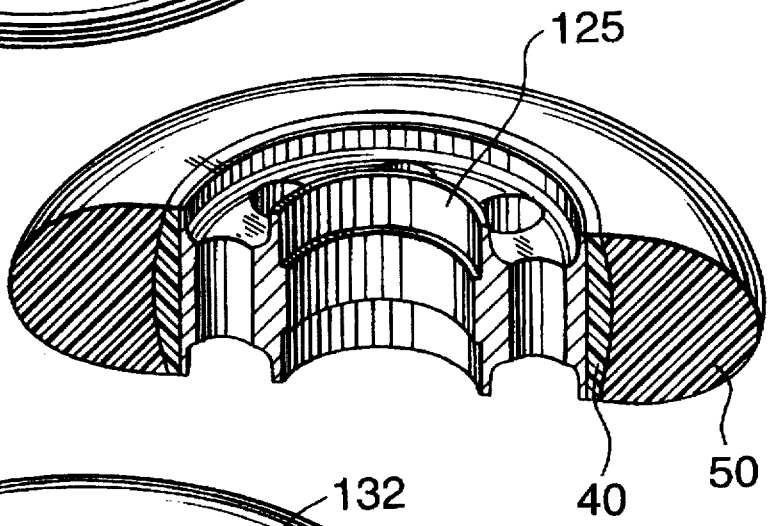
FIG. 29 is a sectional view of the wheel and hub of FIG. 28.

With reference to FIGS. 28 and 29, applicant's dual durometer wheel is shown in combination with a spoked hub 125. Spoked hubs are popular because of their "look". Spoked hubs are primarily a variation on simple tube hubs but may, as shown in FIG. 29, lack a central recess 117. As will therefore be seen best from FIG. 29, inner core 40, which, as shown in this figure, is of the shallow type described above with reference to FIG. 26, is bonded covalently to the hub in the manner known in the art.

Figure 30:
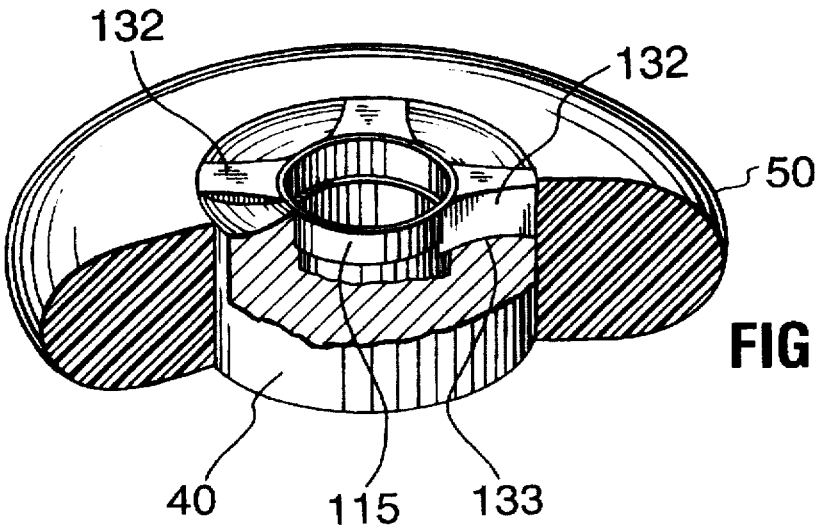
FIG. 30 is a partially cut-away perspective view of a further modified in-line skate wheel.
Figure 31:
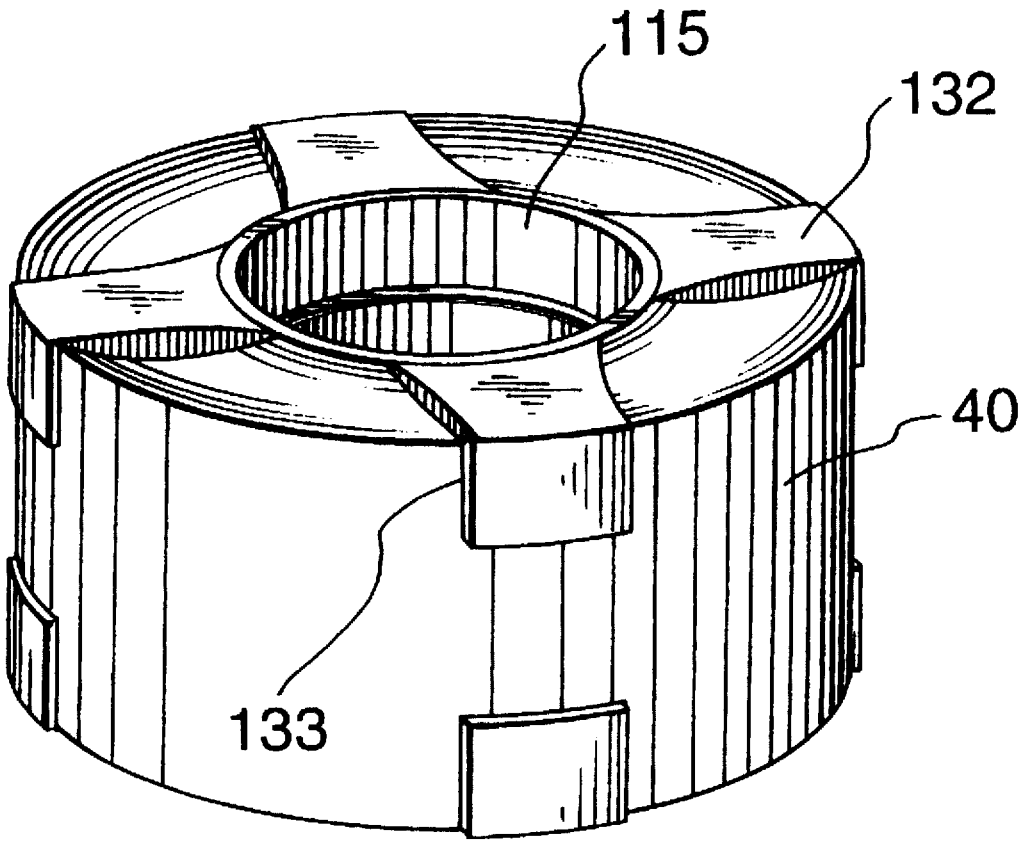
FIG. 31 is a perspective view of the inner core of the wheel of FIG. 30.

Yet another approach to reducing torsional flex is shown with reference to the wheel of FIGS. 30 and 31 wherein like numerals are once again used to denote like elements. The wheel once again comprises an outer core 50 of relatively hard material, a concentrically inner core 40 of relatively softer material (the material for the inner and outer cores typically being a polyurethane), and a hub 115. A plurality of stiffening spokes 132 extend between outer layer 50 and hub 115. The spokes can be of the same material as the outer layer and may be formed integrally therewith when the outer core is formed onto the inner core. In this regard, inner core 40 is formed with cavities 133 corresponding in shape to spokes 132 so that these cavities fill with the harder polyurethane of the outer core during its formation. In the embodiment shown, four trapezoidally shaped spokes are formed at 90° intervals on each side of core 40. Depending upon the degree of stiffening required, there may be more or fewer of such spokes, and the shape and thickness thereof may vary as well.

The foregoing descriptions of the present wheels having two concentric layers 40 and 50 are intended to be exemplary of multi-layered, multi-durometer wheels as contemplated by the present invention. It is intended however that alternative configurations including three or more layers of the same or differing hardnesses and types of material should also fall within the scope of the present invention. For example, a wheel might have three concentric cores or layers (excluding the slip ring) of material, comprising two relatively hard layers sandwiching a relatively softer layer. Or there might be multiple layers of material grading in hardness from the hardest at the outer perimeter to softer and softer layers proceeding towards the hub. There may be instances as well in which it might be useful to use a softer material for the outer core with the harder material being used for the inner core (or cores). Cores of the same relative hardness might be used as might cores of different materials having the same or differing relative hardnesses. Nor is it intended that the cross-sectional shapes of the layers themselves as disclosed herein be limitative. Other shapes are possible without departing from the inventive scope of the present invention.

Providing the improved wheels as described above simplifies choices for consumers who will no longer be put to the election between soft and hard, short or long wearing and so forth. Applicant's wheels provide speed, comfort and durability as well as improved performance in areas of stopping, snow plowing and turning having regard to the scope permitted for lateral movements of the wheels provided by the slip ring.

Hub materials can also be chosen for chemical bonding to the polyurethane outer body.

In one embodiment constructed by the applicant, the radius of curvature of surface 11 of slip ring 10 is 0.100 inch.

For aesthetic purposes, the polyurethane outer bodies can be transparent so that the slip ring is visible. This provides a "high tech" look to the wheel's appearance useful for marketing purposes.

The above-described embodiments of the present invention are meant to be illustrative of preferred embodiments of the present invention and are not intended to limit the scope of the present invention. Various modifications, which would be readily apparent to one skilled in the art, are intended to be within the scope of the present invention. The only limitations to the scope of the present invention are set out in the following appended claims.

I claim:

1. A wheel for an in-line skate, comprising:

hub means for rotation about an axis;

circular ring means disposed concentrically about said hub means, said ring means having an outer ground engaging peripheral surface; and core means disposed concentrically about said hub means for at least partially supporting said ring means in a ground engaging position thereof, said core means comprising at least two different parts, said core means having an outer ground engaging peripheral surface and being made of a material having a higher coefficient of friction compared to said ring means, said core means comprising at least one inner core and an annular outer core, said inner and outer cores being made of material having a predetermined durometric hardness; and wherein the diameter of said ring means exceeds the diameter of said core means to provide a discrete radial transition from said ground engaging surface of said core means to said ground engaging surface of said ring means.

2. The wheel of claim 1 wherein the durometric hardness of said outer core exceeds the durometric hardness of said at least one inner core.

3. The wheel of claim 1 wherein said ring means is secured to said outer core for permanent connection thereto.

4. The wheel of claim 3 wherein said ring means are adapted to transmit compressire loads from said ground engaging surface thereof to said inner core.

5. The wheel of claim 4 wherein said ring means comprise an outer ground engaging portion and an annularly inner ring member of predetermined width.

6. The wheel of claim 5 wherein said ring member is disposed for continuous contact with an opposed annular outer surface of said inner core for load transference to said inner core.

7. The wheel of claim 6 wherein said annular outer surface of said inner core is curved convexly towards said ring member.

8. The wheel of claim 1 wherein the durometric hardness of said inner core falls in the range of Shore 40A to 80A.

9. The wheel of claim 8 wherein the durometric hardness of said outer core falls within the range of Shore 72A to 96A.

10. The wheel of claim 9 wherein the durometric hardness of said ring means falls within the range of Shore D85.

11. A wheel for an in-line skate, comprising:

hub means for rotation about an axis;

circular ring means disposed concentrically about said hub means, said ring means having an outer ground engaging peripheral surface; and core means disposed concentrically about said hub means for at least partially supporting said ring means in a ground engaging position thereof, said core means comprising at least two different parts, said core means having an outer ground engaging peripheral surface and being made of a material having a higher coefficient of friction compared to said ring means;

wherein the diameter of said ring means exceeds the diameter of said core means to provide a discrete radial transition from said ground engaging surface of said core means to said ground engaging surface of said ring means, and a line tangentially intersecting said ground engaging surfaces of both said ring means and said core means defining an angle to said wheel's axis in the range of 15° to 35°.

12. A wheel for an in-line skate, comprising:

hub means for rotation about an axis;

circular ring means disposed concentrically about said hub means, said ring means having an outer ground engaging peripheral surface; and core means disposed concentrically about said hub means for at least partially supporting said ring means in a ground engaging position thereof, said core means comprising at least two different parts, said core means having an outer ground engaging peripheral surface and being made of a material having a higher coefficient of friction compared to said ring means;

wherein said ground engaging surface of said ring means is curved convexly outwardly and the diameter of said ring means exceeds the diameter of said core means to provide a discrete radial transition from said ground engaging surface of said core means to said ground engaging surface of said ring means.

13. A wheel for an in-line skate, comprising:

hub means for rotation about an axis;

circular ring means disposed concentrically about said hub means, said ring means having an outer ground engaging peripheral surface; and core means disposed concentrically about said hub means for at least partially supporting said ring means in a ground engaging position thereof, said core means comprising at least two different parts, said core means having an outer ground engaging peripheral surface and being made of a material having a higher coefficient of friction compared to said ring means;

wherein the diameter of said ring means exceeds the diameter of said core means to provide a discrete radial transition from said ground engaging surface of said core means to said ground engaging surface of said ring means, and said ring means comprises an outer ground engaging portion and an annularly inner ring member of predetermined width.

14. A skate wheel for an in-line skate, comprising:

hub means for rotation about an axis;

a plurality of layers of material disposed concentrically about said hub means, each of said plurality of layers consisting of a material having a predetermined durometric hardness;

said plurality of layers comprising at least one inner core disposed concentrically about said hub means and at least one outer core disposed concentrically about said inner core, said at least one outer core including an outer surface adapted for rolling over a surface;

wherein the durometric hardness of said at least one outer core exceeds the durometric hardness of said at least one inner core; and ring means annularly disposed in said outer core, said ring means having an outer ground engaging peripheral surface, the diameter of said ring means exceeding the diameter of said outer core such that the ground engaging surface of said ring means protrudes radially outwardly from said outer surface of said outer core.

15. The wheel of claim 14 wherein the coefficient of friction of said material comprising said ring means is less than the coefficient of friction of said material comprising said outermost layer whereby said ring means facilitates sliding motion of said wheel relative to a surface.

16. The wheel of claim 15 wherein said ring means is pliant for flexion thereof.

17. The wheel of claim 16 wherein said ring means are pliant for compressibility thereof.

18. The wheel of claim 17 wherein said ground engaging surface of said ring means is curved convexly outwardly.

19. A skate wheel for an in-line skate, comprising:

hub means for rotation about an axis;

a plurality of layers of material disposed concentrically about said hub means, each of said plurality of layers consisting of a material having a predetermined durometric hardness;

said plurality of layers comprising at least one inner core disposed concentrically about said hub means and at least one outer core disposed concentrically about said inner core, said at least one outer core including an outer surface adapted for rolling over a surface;

wherein the durometric hardness of said at least one outer core exceeds the durometric hardness of said at least one inner core; and stiffening means disposed in said inner core to prevent excessive flexure thereof due to torsional loading of said wheel.

20. The wheel of claim 19 wherein said stiffening means comprise spoke members of relatively stiff material in said inner core.

21. The wheel of claim 20 wherein said spoke members extend from said hub means to said outer core.

22. The wheel of claim 21 wherein said spoke members are formed integrally with said outer core.

23. The wheel of claim 19 wherein said stiffening means comprise a spine member disposed annularly within said inner core.

* * * * *